US011628333B2

(12) United States Patent
Chen

(10) Patent No.: US 11,628,333 B2
(45) Date of Patent: Apr. 18, 2023

(54) ANKLE EXERCISER

(71) Applicant: Yu Hsiang Chen, Taichung (TW)

(72) Inventor: Yu Hsiang Chen, Taichung (TW)

( * ) Notice: Subject to any disclaimer, the term of this patent is extended or adjusted under 35 U.S.C. 154(b) by 135 days.

(21) Appl. No.: 17/230,766

(22) Filed: Apr. 14, 2021

(65) Prior Publication Data

US 2021/0379444 A1 Dec. 9, 2021

(30) Foreign Application Priority Data

Jun. 8, 2020 (TW) ..... 109119203

(51) Int. Cl.

| | |
|---|---|
| ***A63B 23/08*** | (2006.01) |
| ***A63B 21/00*** | (2006.01) |
| ***A63B 21/02*** | (2006.01) |
| ***A63B 22/14*** | (2006.01) |
| ***A63B 23/035*** | (2006.01) |
| ***A63B 23/00*** | (2006.01) |
| ***A63B 21/008*** | (2006.01) |
| ***A63B 69/00*** | (2006.01) |

(52) U.S. Cl.

CPC ..... *A63B 23/085* (2013.01); *A63B 21/00058* (2013.01); *A63B 21/0085* (2013.01); *A63B 21/023* (2013.01); *A63B 21/4011* (2015.10); *A63B 21/4015* (2015.10); *A63B 21/4034* (2015.10); *A63B 21/4035* (2015.10); *A63B 21/4047* (2015.10); *A63B 21/4049* (2015.10); *A63B 22/14* (2013.01); *A63B 23/03541* (2013.01); *A63B 23/08* (2013.01); *A63B 69/0062* (2020.08); *A63B 21/0083* (2013.01); *A63B 2023/006* (2013.01); *A63B 2210/50* (2013.01); *A63B 2225/093* (2013.01)

(58) Field of Classification Search

CPC ..... A63B 21/00058; A63B 21/0085; A63B 21/023; A63B 21/4034; A63B 21/4035; A63B 21/4047; A63B 21/4049; A63B 22/14; A63B 69/0062; A63B 21/0083; A63B 2023/006; A63B 2210/50; A63B 2225/093; A63B 22/16; A63B 2022/185; A63B 2071/0072; A63B 2225/09; A63B 23/08–085; A63B 22/18; A63B 21/008–0089; A63B 21/02–025; A63B 21/05–0557; A63B 21/40; A63B 21/4001; A63B 21/4011–4015; A63B 23/03516–03541; A63B 23/04; A61H 1/0266; A61H 2201/1642

See application file for complete search history.

(56) References Cited

U.S. PATENT DOCUMENTS 2,206,902 A * 7/1940 Kost ..... A61H 1/0266 74/25
3,421,760 A * 1/1969 Freeman, Jr. ..... A63B 21/1609 482/130

(Continued)

*Primary Examiner* — Joshua Lee
*Assistant Examiner* — Catrina A Letterman
(74) *Attorney, Agent, or Firm* — Che-Yang Chen; Law Office of Michael Chen

(57) ABSTRACT

An ankle exerciser for exercising a user's ankles and includes a base, two pedals and two rotary units. The pedals and the rotary units are installed to the base. The rotary units are located between the base and the pedals so as to allow the pedals to be pivoted in multiple directions so as to stretch the ankles, and to keep ankles healthy.

15 Claims, 13 Drawing Sheets

(56) References Cited

U.S. PATENT DOCUMENTS

| | | | | | |
|---|---|---|---|---|---|
| 3,782,721 | A * | 1/1974 | Passera | A63B 22/16 | 482/79 |
| 4,739,986 | A * | 4/1988 | Kucharik | A63B 23/08 | 482/79 |
| 5,368,536 | A * | 11/1994 | Stodgell | A63B 22/18 | 482/79 |
| 5,413,543 | A * | 5/1995 | Drago | A63B 23/16 | 482/79 |
| 6,692,419 | B2 * | 2/2004 | Chen | A63B 22/18 | 482/79 |
| 6,821,235 | B1 * | 11/2004 | Johnson | A63B 21/4015 | 482/79 |
| 7,614,990 | B2 * | 11/2009 | Baek | A63B 22/14 | 482/79 |
| 7,892,154 | B1 * | 2/2011 | Alexa | A63B 21/0083 | 482/79 |
| 8,827,882 | B2 * | 9/2014 | Rogers | A63B 21/4033 | 482/146 |
| 9,162,106 | B1 * | 10/2015 | Scheiman | A63B 21/0552 | |
| 9,616,275 | B1 * | 4/2017 | Rogoff | A63B 23/03508 | |
| 10,434,365 | B2 * | 10/2019 | Mack | A63B 21/0552 | |
| 2004/0097343 | A1 * | 5/2004 | Chen | A63B 71/0036 | 482/79 |
| 2006/0084554 | A1 * | 4/2006 | Bement | A63B 22/18 | 482/79 |
| 2014/0100087 | A1 * | 4/2014 | Ha | A61H 1/0266 | 482/91 |
| 2018/0318639 | A1 * | 11/2018 | Kim | A63B 22/0046 | |
| 2019/0321681 | A1 * | 10/2019 | Stahnke | A63B 21/4034 | |

* cited by examiner

ANKLE EXERCISER

BACKGROUND OF THE INVENTION

1. Fields of the Invention

The present invention relates to an exerciser, and more particularly, to an ankle exerciser.

2. Descriptions of Related Art

For some people who are prone to leg soreness and stiffness due to long working hours and standing for a long time. Those who are suffered by the problems mentioned above need to see doctors and visit medical institutions for treatment to relax and soften leg muscles through rehabilitation and stretching.

It is noted that the aforementioned stretching equipment is relatively large, and it is unlikely to be placed in homes. Therefore, the applicant develops an ankle exerciser that is compact in size and is suitable for being put at home. The ankle exercise provides features of relaxing and soften leg muscles through stretching.

The present invention intends to provide an ankle exerciser to eliminate the shortcomings mentioned above.

SUMMARY OF THE INVENTION

The present invention relates to an ankle exerciser and comprises a base, two pedals and two rotary units. The base includes a bar and a U-shaped frame. The bar is transversely connected to the frame and includes two installation positions.

The two pedals are respectively installed to the bar. Each pedal includes a board and a first belt which is mounted to the board. A socket is connected to the underside of each of the two pedals and includes a plate, a brace and a ball bearing. The plate is located between the underside of the pedal and the brace. The brace includes a room in which the ball bearing is located.

The two rotary units are respectively located between the base and the two pedals so that the two pedals are rotatable by the two rotary units. Each rotary unit includes a shaft, a cup, a damp unit, a collar and a joint unit. A bolt extends through the shaft, the cup, the damp unit, the collar and the joint unit so as to be connected to the joint unit. The shaft is located on the top of the bar and located corresponding to the installation position. The shaft includes a passage defined axially through. A bottom portion is formed to the lower end of the shaft. The cup contacts the bottom portion. The damp unit is located between the cup and the collar. The collar positions the socket and includes a receiving portion facing downward in which the damp unit is received. The joint unit includes a ball formed to the top end thereof. The ball bearing is mounted to the ball. The lower section of the joint unit is inserted into the passage of the shaft. The bolt is connected to a threaded hole in the lower section of the joint unit.

When in use, each of the pedals is pivoted about the joint unit, and each of the pedals returns by the damp unit.

Preferably, the bottom portion of the shaft includes ratchets with different heights. The cup includes engaging portions formed in the inner periphery thereof. When the cup is rotated, the engaging portions are detachably engaged with the ratchets to generate different damp levels to the damp unit.

Preferably, each pedal includes two paths which are formed between the board and the plate. The two paths are located corresponding to the front end and the second end of the board. Two restriction members respectively restrict the two pedals relative to the bar. Each one of the two restriction members is a loop, and the loop goes below the bar and extends through the two paths of each board to restrict the two pedals relative to the bar.

Preferably, a handle is connected to the base and includes a post and am armrest. The user's hands are able to rest on the armrest.

Preferably, the base includes two lugs, and the post of the handle is pivotably connected between the two lugs by a pin so that the base is pivoted relative to the handle.

Preferably, multiple resilient members are connected between the post and the two lugs. Each lug includes a groove, and two notches are formed in two ends of each groove, and communicate with the groove. One of two ends of each resilient members is connected to the pin. A rod movably extends through the two grooves and is removably engaged with one of the two notches of each groove to position the post.

Preferably, the post includes a slot. A restriction part is adjustably movable along the slot of the post so as to position a user's legs.

Preferably, the restriction part includes two second belts and a bridge. The second belts are adapted to position the user's legs.

The primary object of the present invention is to provide an ankle exerciser which includes a rotary unit located between each pedal and the base of the exerciser. The rotary unit allows the pedal to be pivoted in multiple directions to stretch and exerciser the ankles.

Another object of the present invention is to provide an ankle exerciser that is compact in size and easily used at home.

The advantages of the present invention are that the ankle exerciser is compact in size which saves room when in use, and easily stored.

The damp force for the exerciser is adjustable according to the practical needs of different users.

The ankle exerciser also exerciser the muscles of the user's legs to reduce soreness of legs.

The ankle exerciser can be operated in standing posture or sitting posture.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 3-1 is an enlarged view to show the ratchets of the bottom portion of the shaft;

FIG. 3-2 is a cross sectional view, taken along line C-C in FIG. 3;

DETAILED DESCRIPTION OF THE PREFERRED EMBODIMENT

Figure 1:
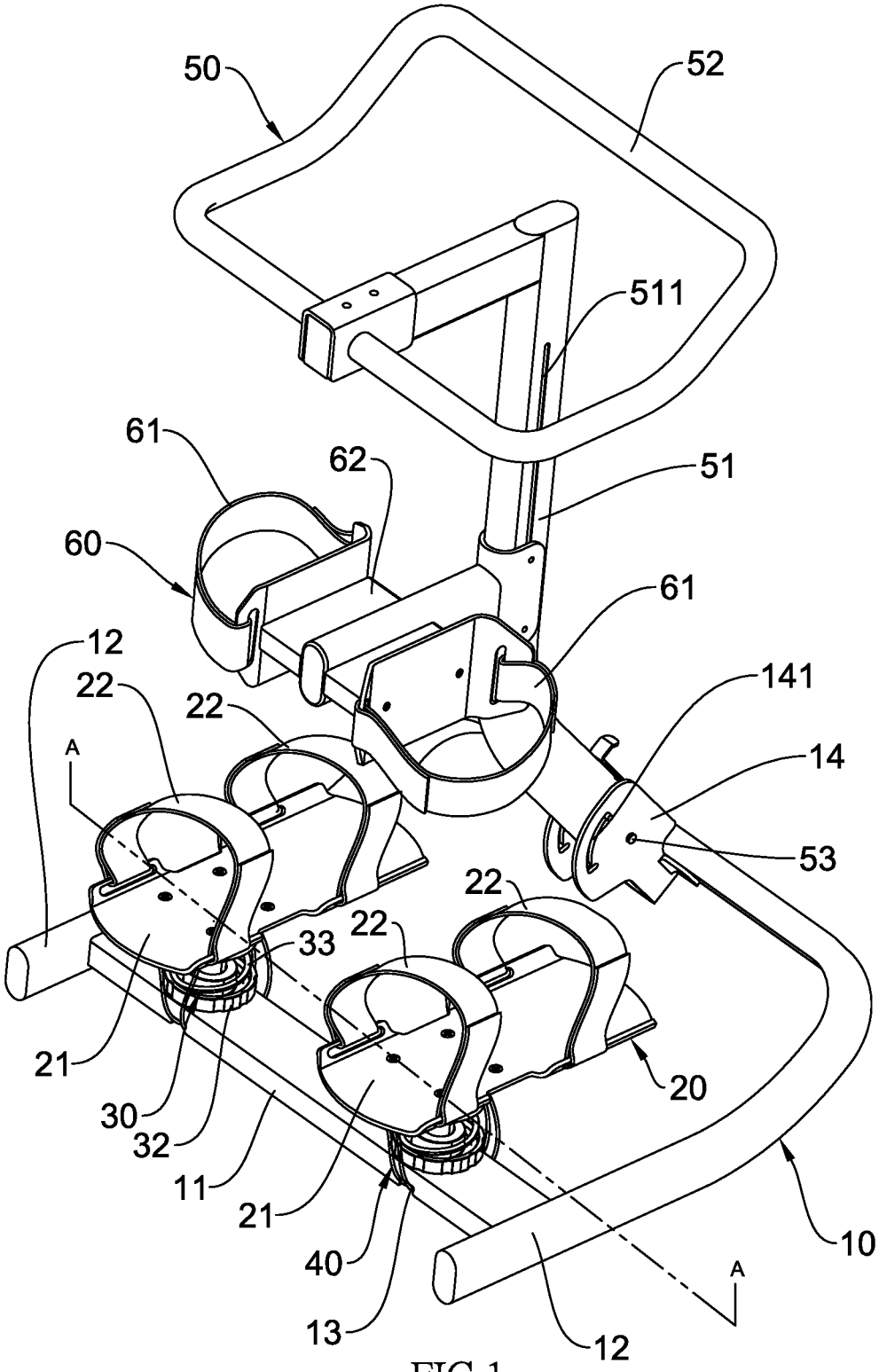
FIG. 1 is a perspective view to show the ankle exerciser of the present invention.
Figure 2:
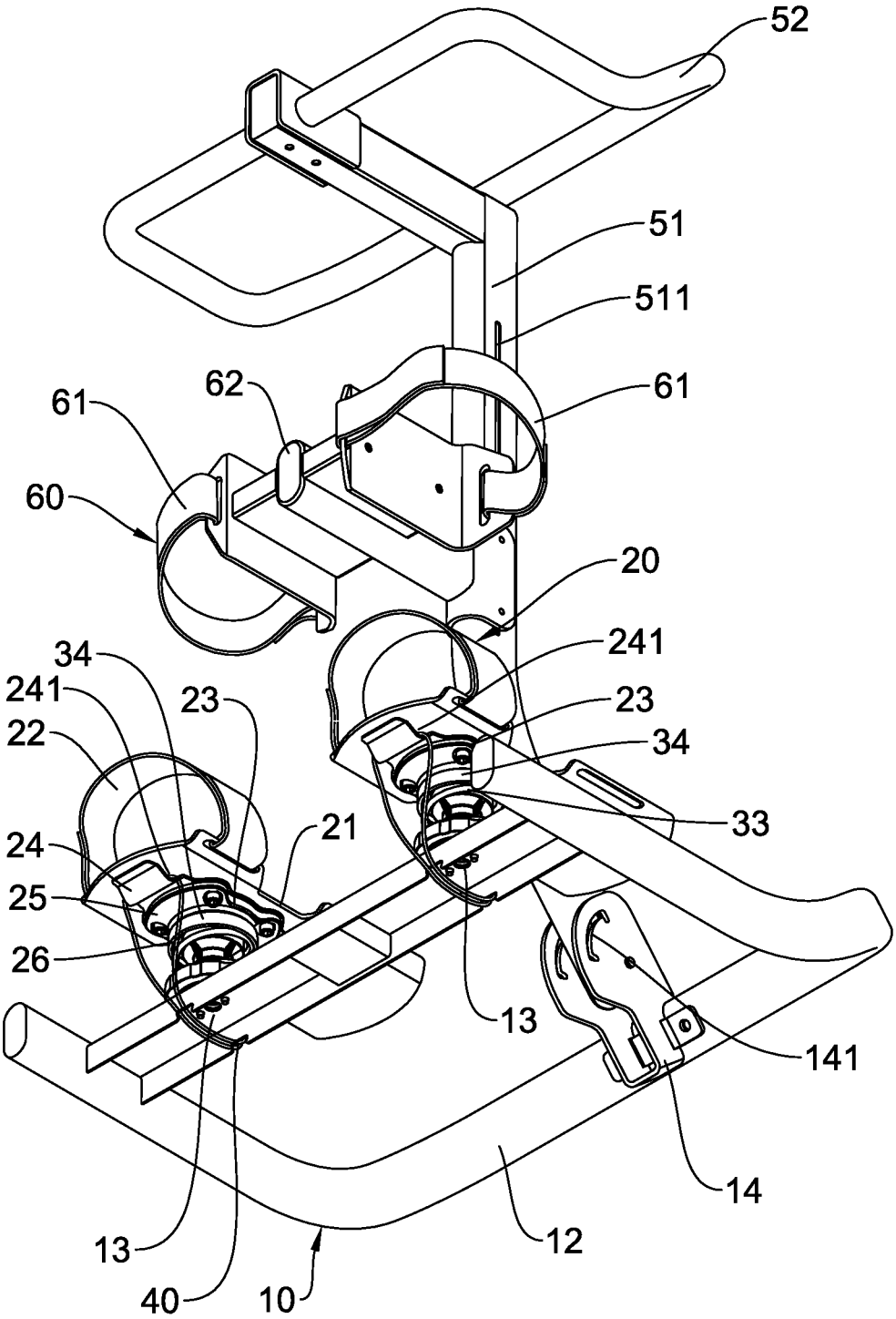
FIG. 2 is another perspective view to show the ankle exerciser of the present invention.
Figures 1, 2, 3:
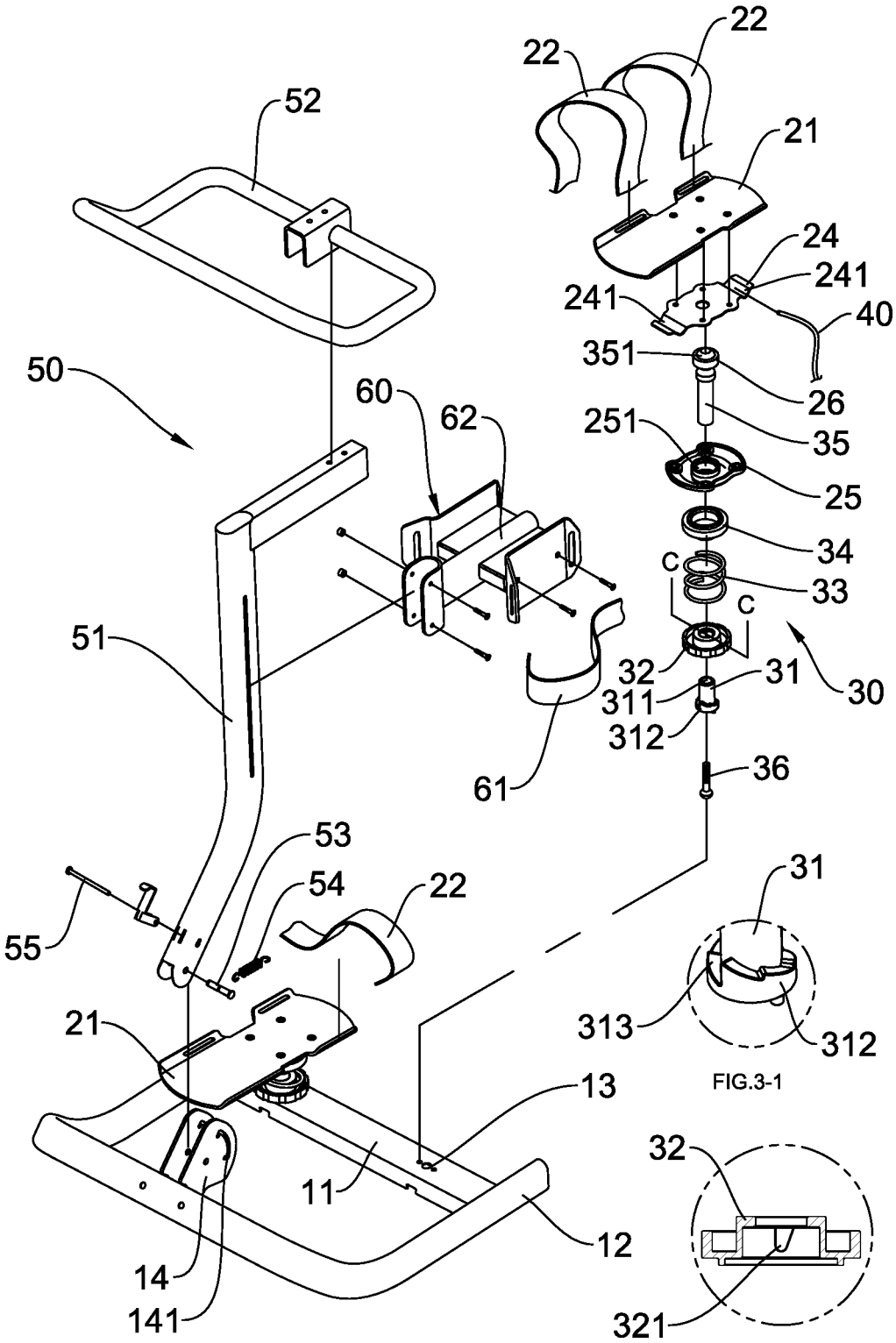
FIG. 3 is an exploded view of the ankle exerciser of the present invention.
Figure 4:
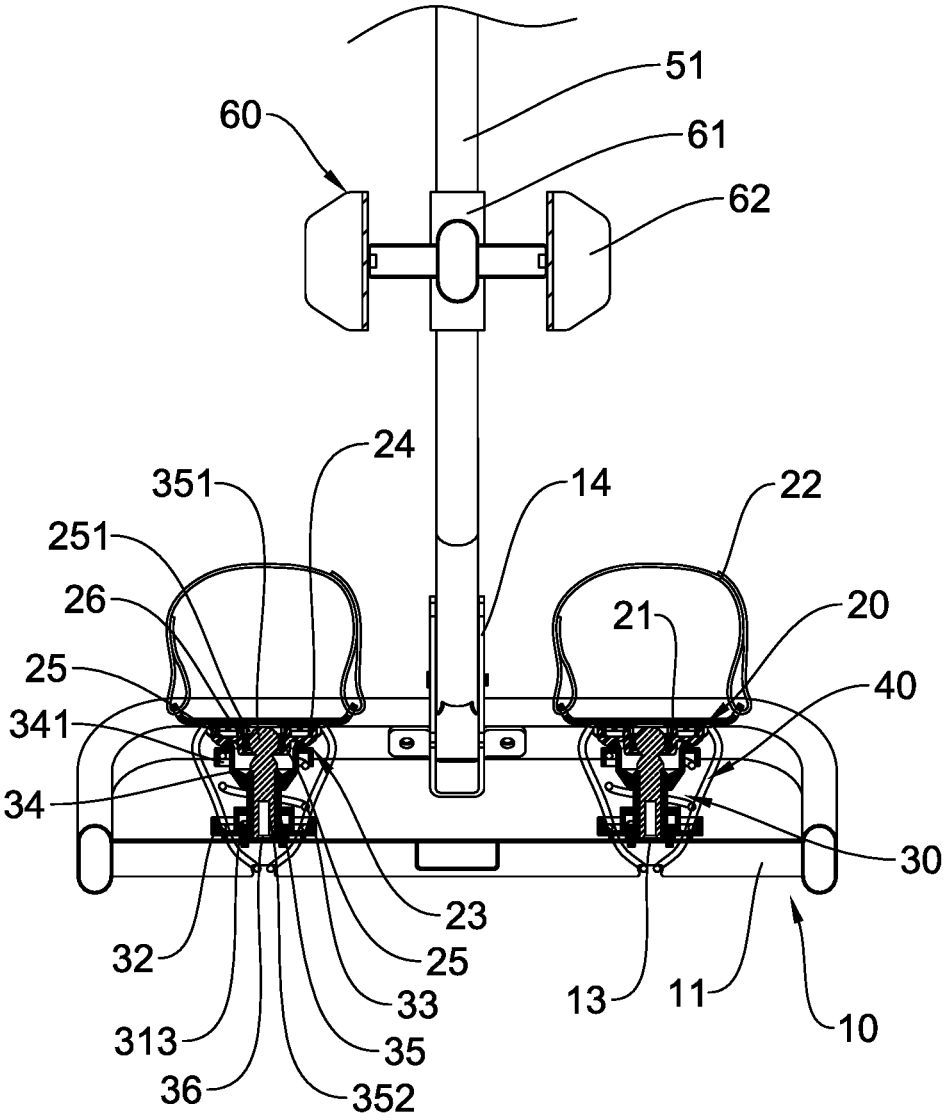
FIG. 4 is a cross sectional view, taken along line A-A in FIG. 1.
Figure 5:
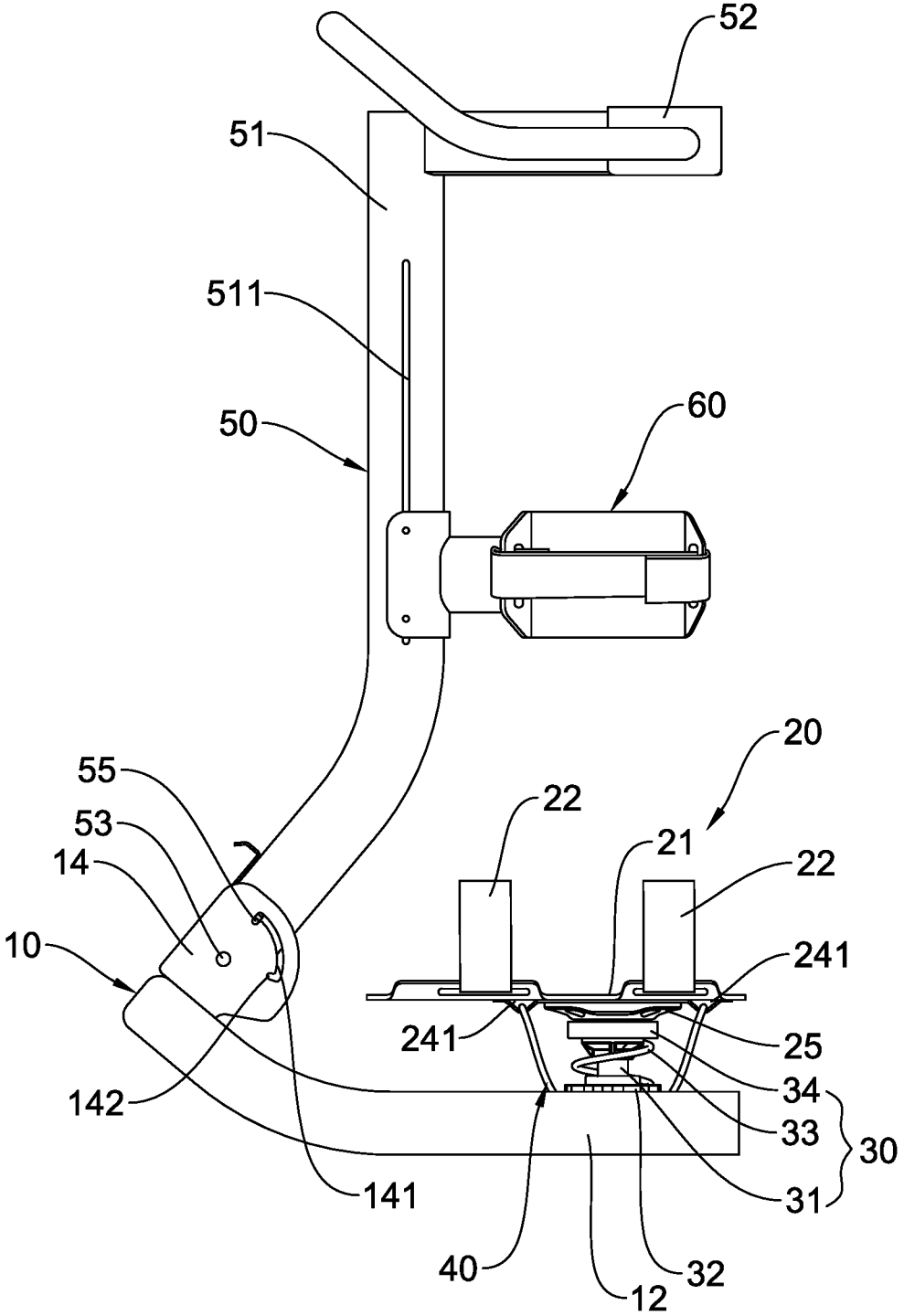
FIG. 5 is a side view of the ankle exerciser of the present invention.

Referring to FIGS. 1 to 3, the ankle exerciser of the present invention comprises a base 10, two pedals 20 and two rotary units 30 that allow the pedals 20 to be pivoted, two restriction members 40, a handle 50 and a restriction part 60.

The base 10 includes a bar 11 and a U-shaped frame 12. The bar 11 is transversely connected to the frame 12 and includes two installation positions 13.

As shown in FIGS. 1 to 4, the two pedals 20 are respectively installed to the installation positions 13 of the bar 11. Each pedal 20 includes a board 21 and a first belt 22 which is mounted to the board 21. A socket 23 connected to the underside of each of the two pedals 20 and includes a plate 24, a brace 25 and a ball bearing 26. The plate 24 is located between the underside of the pedal 20 and the brace 25. The brace 25 includes a room 251 in which the ball bearing 26 is located.

As shown in FIGS. 1 to 5, the two rotary units 30 are respectively located between the base 10 and the two pedals 20 so that the two pedals 20 are rotatable by the two rotary units 30. Each rotary unit 30 includes a shaft 31, a cup 32, a damp unit 33, a collar 34 and a joint unit 35. A bolt 36 extends through the shaft 31, the cup 32, the damp unit 33, the collar 34 and the joint unit 35 so as to be connected to the joint unit 35. The shaft 31 is located on the top of the bar 11 and located corresponding to the installation position 13. The shaft 31 includes a passage 311 defined axially through, and a bottom portion 312 is formed to a lower end of the shaft 31. The cup 32 contacts the bottom portion 312. The damp unit 33 is located between the cup 32 and the collar 34. The collar 34 positions the socket 23 and includes a receiving portion 341 facing downward in which the damp unit 33 is received. The joint unit 35 includes a ball 351 formed to the top end thereof, and the ball bearing 26 is mounted to the ball 351. The lower section of the joint unit 35 is inserted into the passage 311 of the shaft 31. The bolt 36 mentioned before is connected to a threaded hole 352 in the lower section of the joint unit 35.

Figure 6:
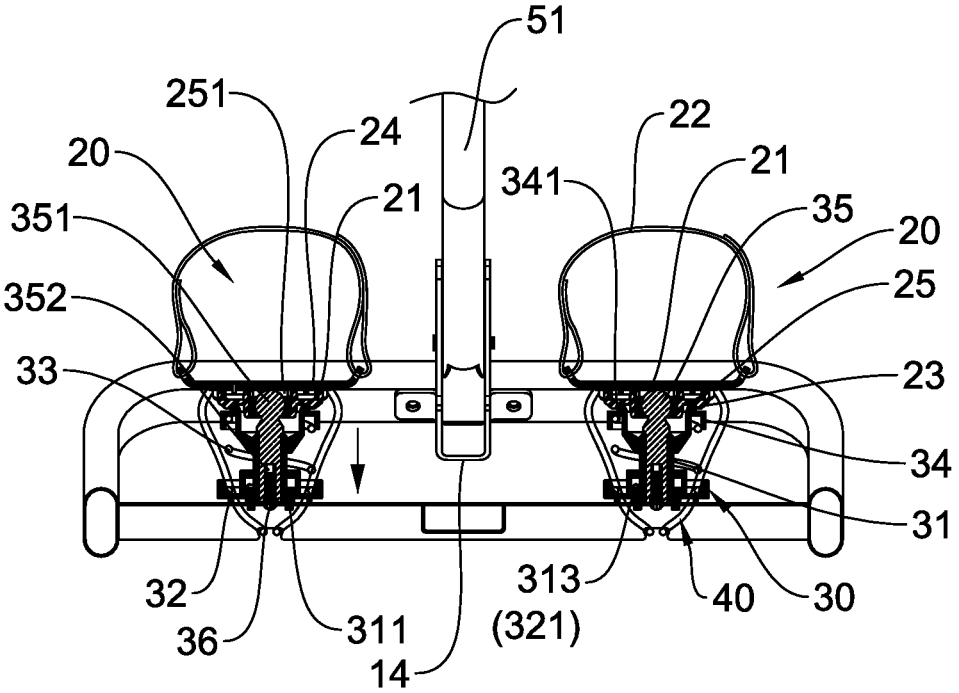
FIG. 6 shows that the cups of the rotary units move downward.
Figure 7:
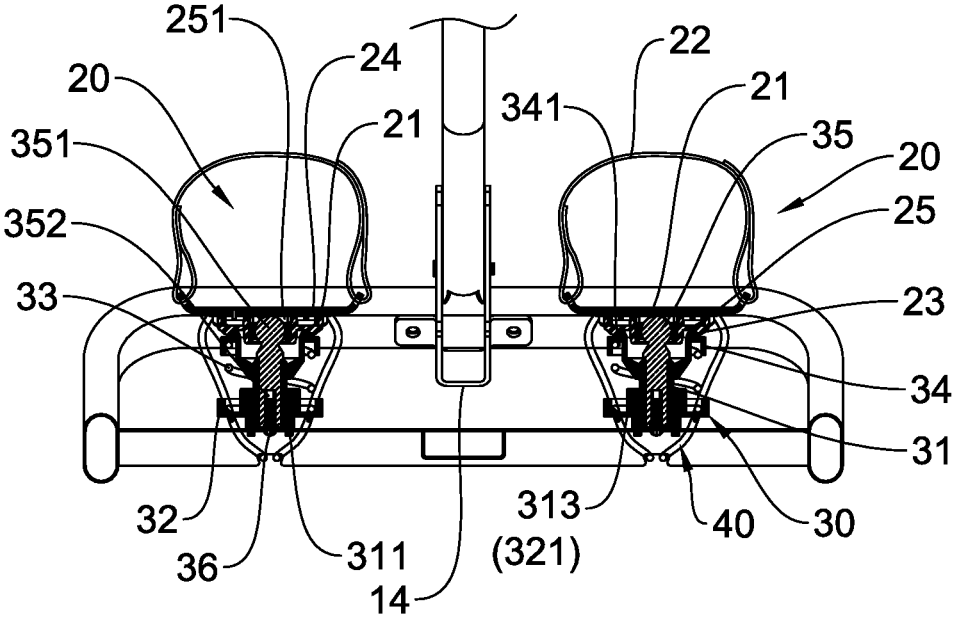
FIG. 7 shows that the cups of the rotary units move upward.

As shown in FIGS. 3, 6 and 7, the bottom portion 312 of the shaft 31 includes ratchets 313 with different heights as shown in FIG. 3-1. The cup 32 includes engaging portions 321 formed in the inner periphery thereof as shown in FIG. 3-2. When the cup 32 is rotated, the engaging portions 321 are detachably engaged with the ratchets 313 to generate different damp levels to the damp unit 33. As shown in FIG. 6, when the engaging portions 321 move downward along the ratchets 313, the damp force of the damp unit 33 is reduced so that the pedals 20 are easily pivoted. As shown in FIG. 7, when the engaging portions 321 move upward along the ratchets 313, the damp force of the damp unit 33 is increased so that the users have to apply more force to pivot the pedals 20.

As shown in FIGS. 2, 5, 6 and 7, each pedal 20 includes two paths 241 which are formed between the board 21 and the plate 24. The two paths 241 are located corresponding to the front end and the second end of the board 21. The two restriction members 40 are used to respectively restrict the two pedals 20 relative to the bar 11. Each restriction member 40 can be a loop, and each one of the two restriction members 40 goes below the bar 11 and extends through the two paths 241 of each board 21 to restrict the two pedals 20 relative to the bar 11. The pedals 20 return by the restriction members 40.

Figure 8:
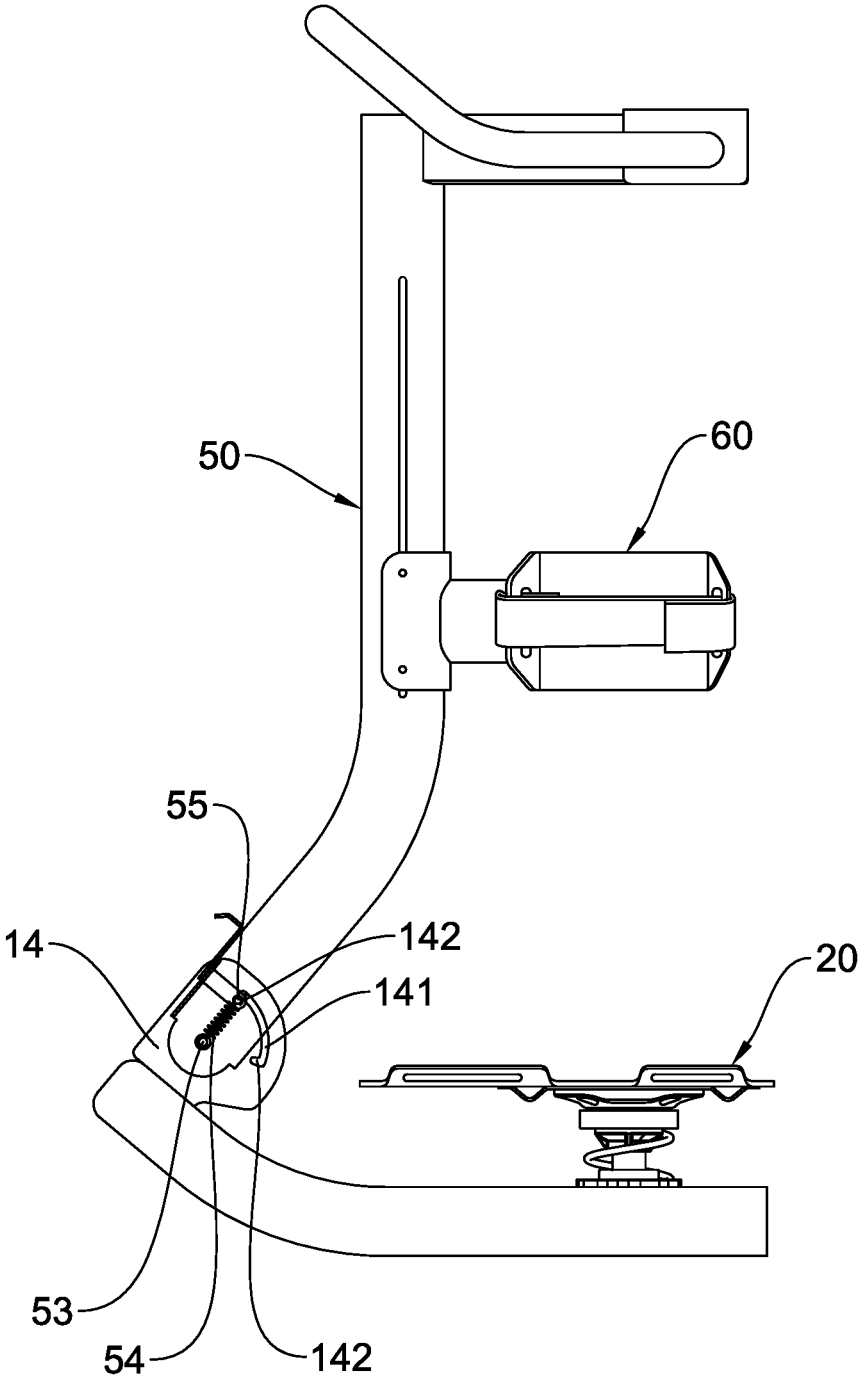
FIGS. 8 and 9 show the operation of the handle of the ankle exerciser of the present invention.
Figure 9:
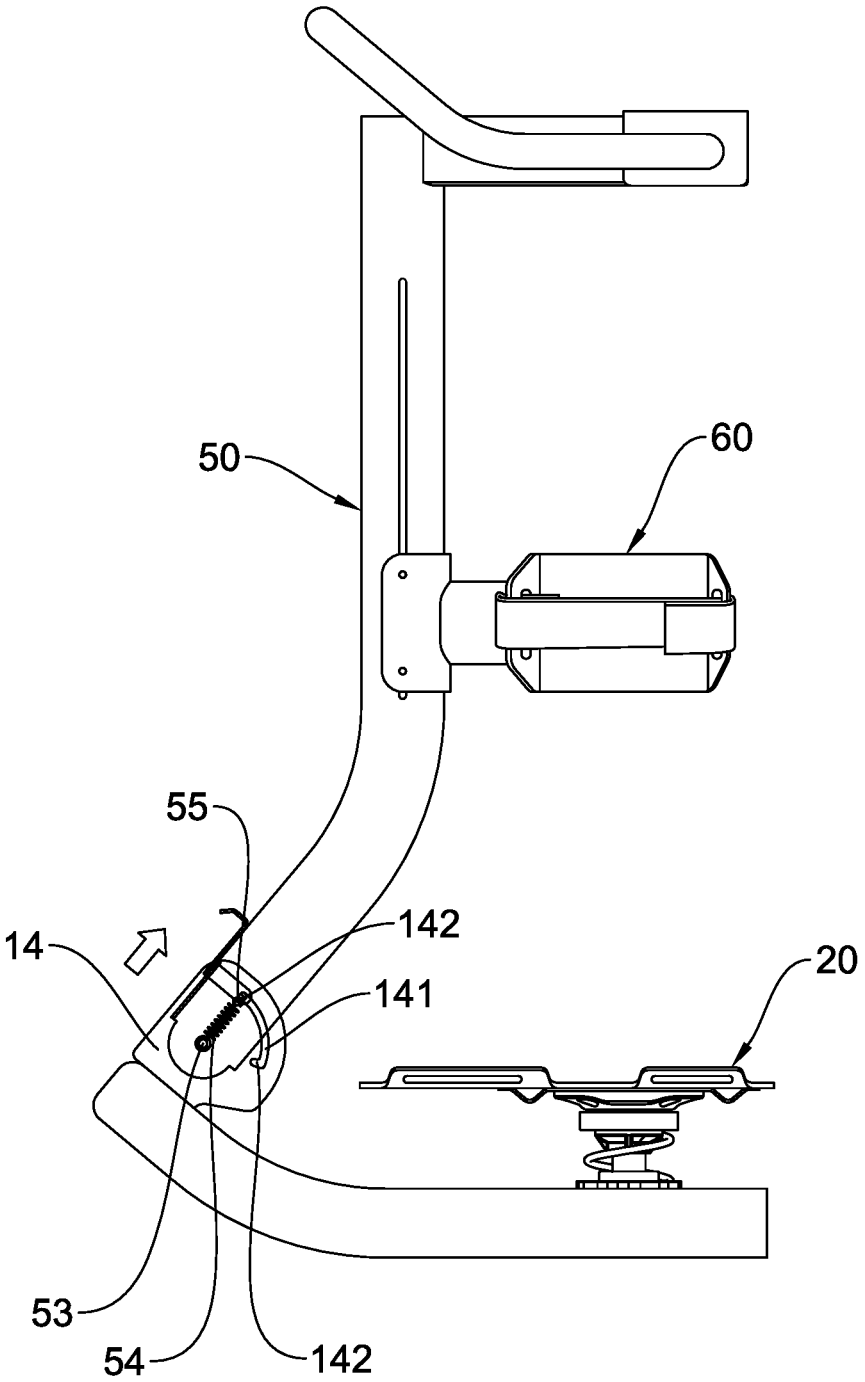
Figure 10:
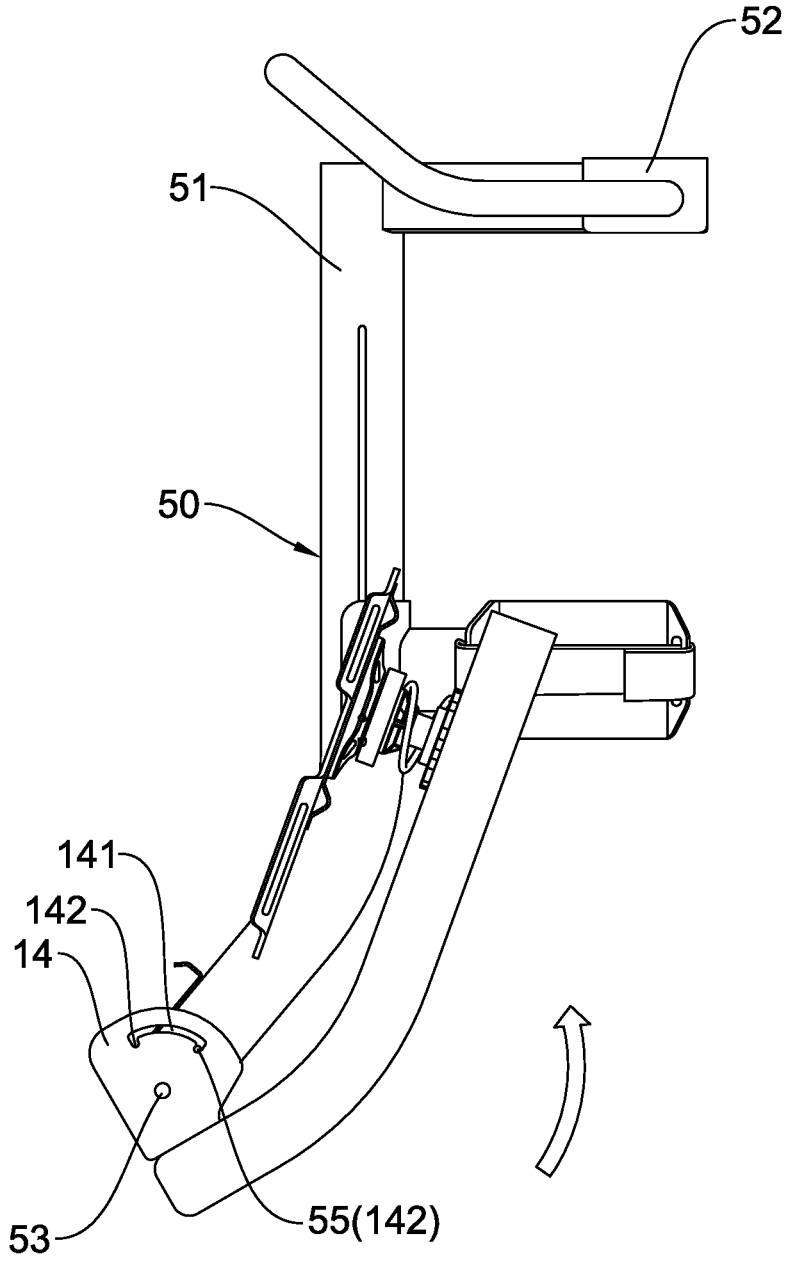
FIG. 10 shows the folded status of the ankle exerciser of the present invention.
Figure 11:
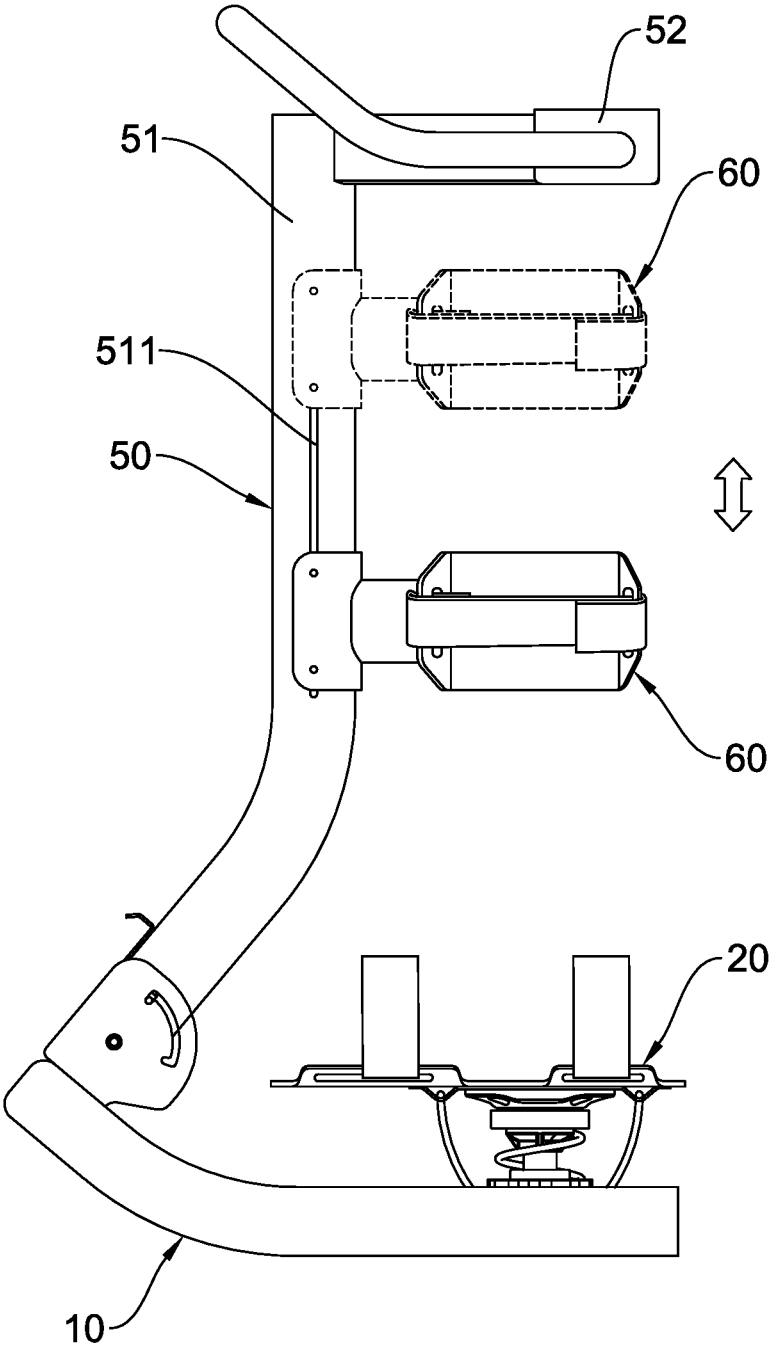
FIG. 11 shows that the restriction part is adjusted.

As shown in FIGS. 1 to 3, 5, 8 to 11, the handle 50 is used to support the user's body. The handle 50 includes a post 51 and an armrest 52 which is formed to the top of the post 51. The base 10 includes two lugs 14, and the post 51 of the handle 50 is pivotably connected between the two lugs 14 by a pin 53 so that the base 10 is pivoted relative to the handle 50. As shown in FIGS. 8 to 10, multiple resilient members 54 are connected between the post 51 and the two lugs 14. Each lug 14 includes a groove 141. Two notches 142 are formed in two ends of each groove 141, and communicate with the groove 141. One of two ends of each resilient members 54 is connected to the pin 53. A rod 55 movably extends through the two grooves 141 and is removably engaged with one of the two notches 142 of each groove 141 to position the post 51. As shown in FIG. 10, the ankle exerciser can be folded by pivoting the base 10 toward the post 51.

Figure 14:
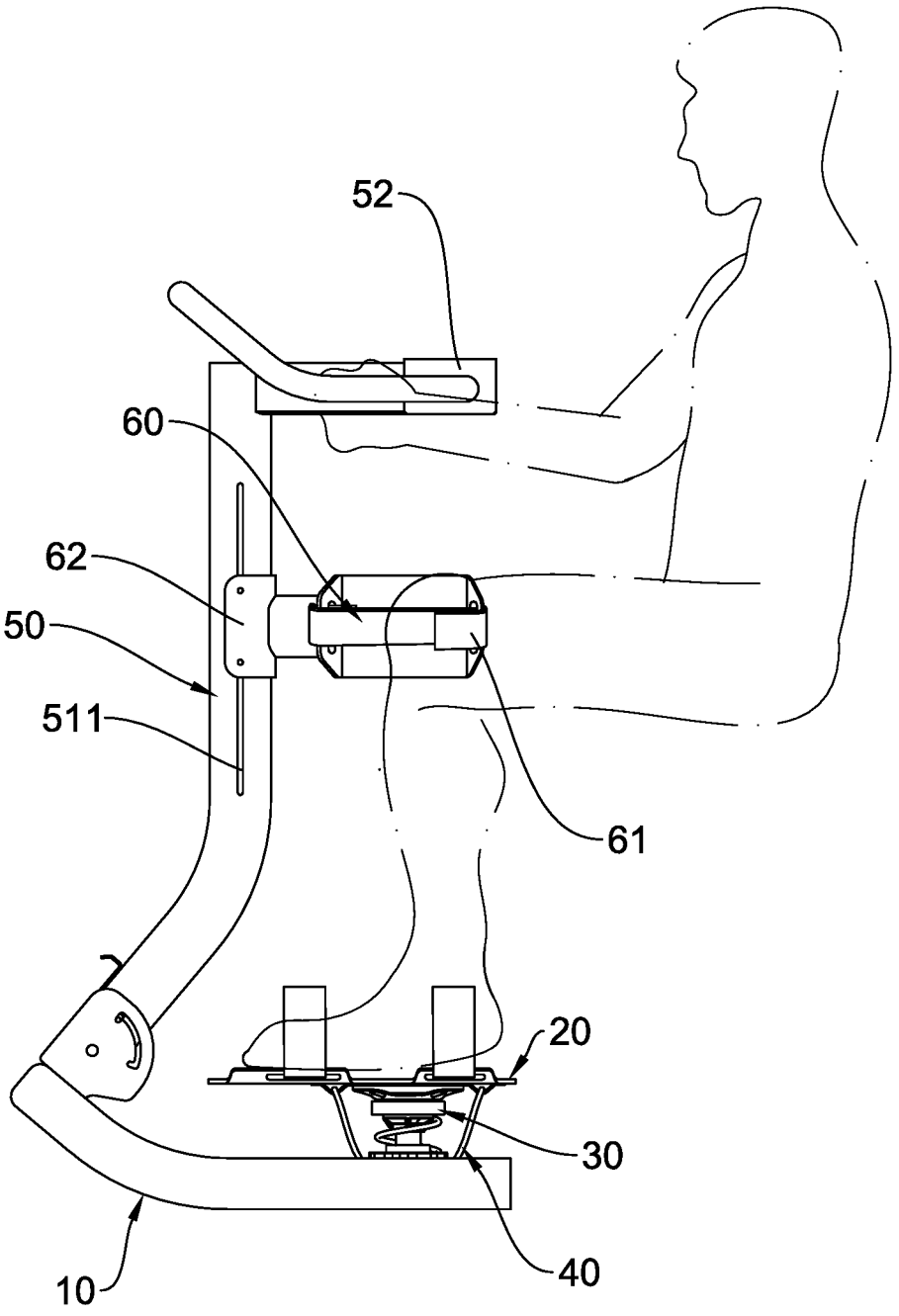
FIG. 14 shows a user operates the ankle exerciser of the present invention in sitting posture.

As shown in FIG. 14, the post 51 includes a slot 511. A restriction part 60 is adjustably movable along the slot 511 of the post 51 so as to position a user's legs. The restriction part 60 includes two second belts 61 and a bridge 62. Two contact plates are formed to two sides of the bridge 62. The second belts 61 are connected to the two contact plates so as to position the user's legs. The bridge 62 can also be adjustable along the post 51 by gears, cooperation of chains and chainwheel, cooperation of positioning pin and positioning holes.

Figure 12:
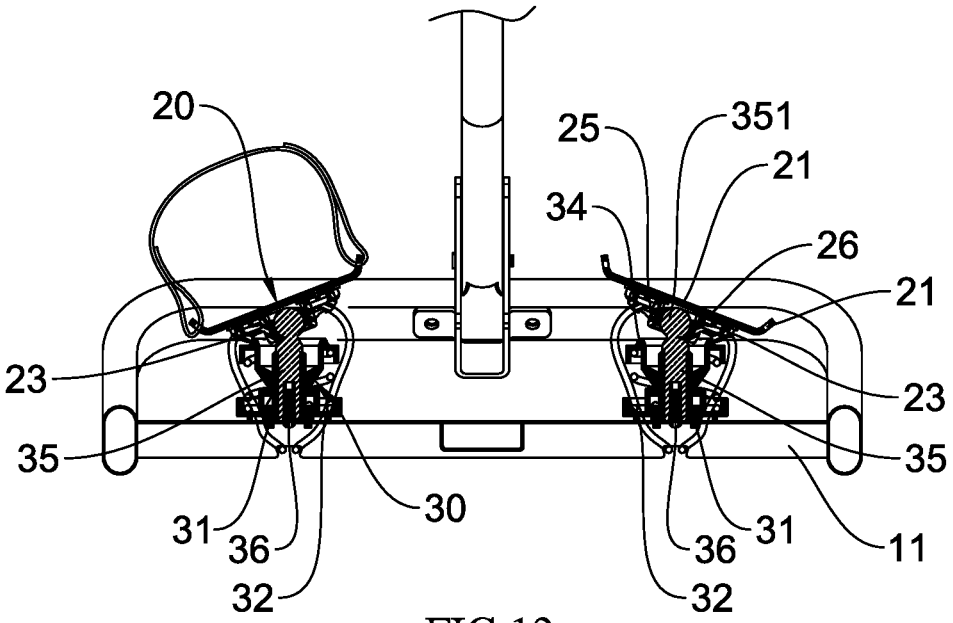
FIGS. 12 and 13 show the operation status of the rotary units of the ankle exerciser of the present invention.
Figure 13:
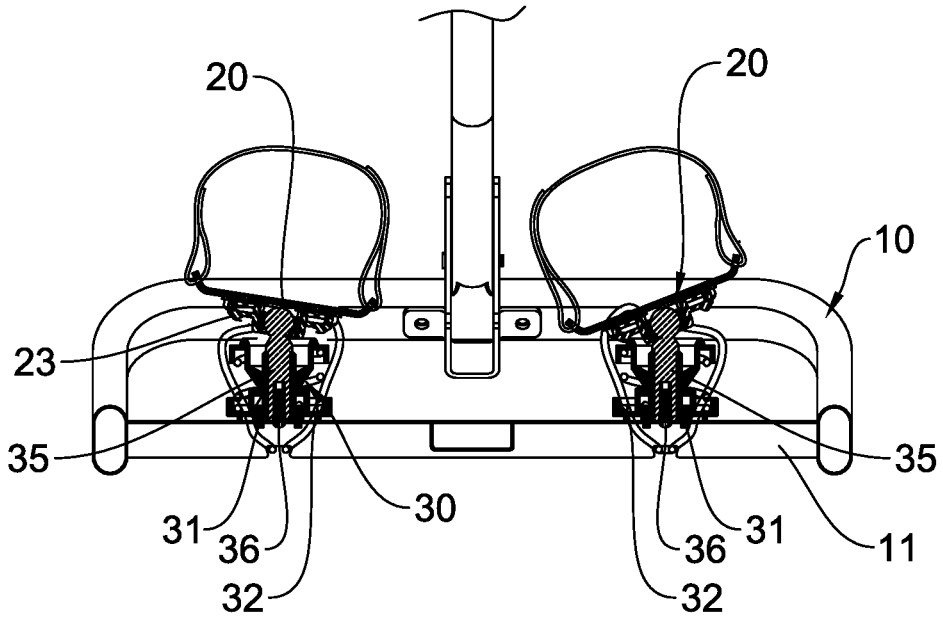

As shown in FIGS. 12 and 13, the user's step on the pedals 20 and positioned by the first belts 22. The user applies a force to pivot the pedals 20. By the joint units 35 on the bar 11, the sockets 23 pivot in multiple direction because the ball bearings 26 are rotatable relative to the ball 351, so that the user's ankles, joints, legs are exercised. Furthermore, as shown in FIGS. 6 and 7, the cups 32 can be moved upward or downward, different levels of exercise can be obtained.

Figure 15:
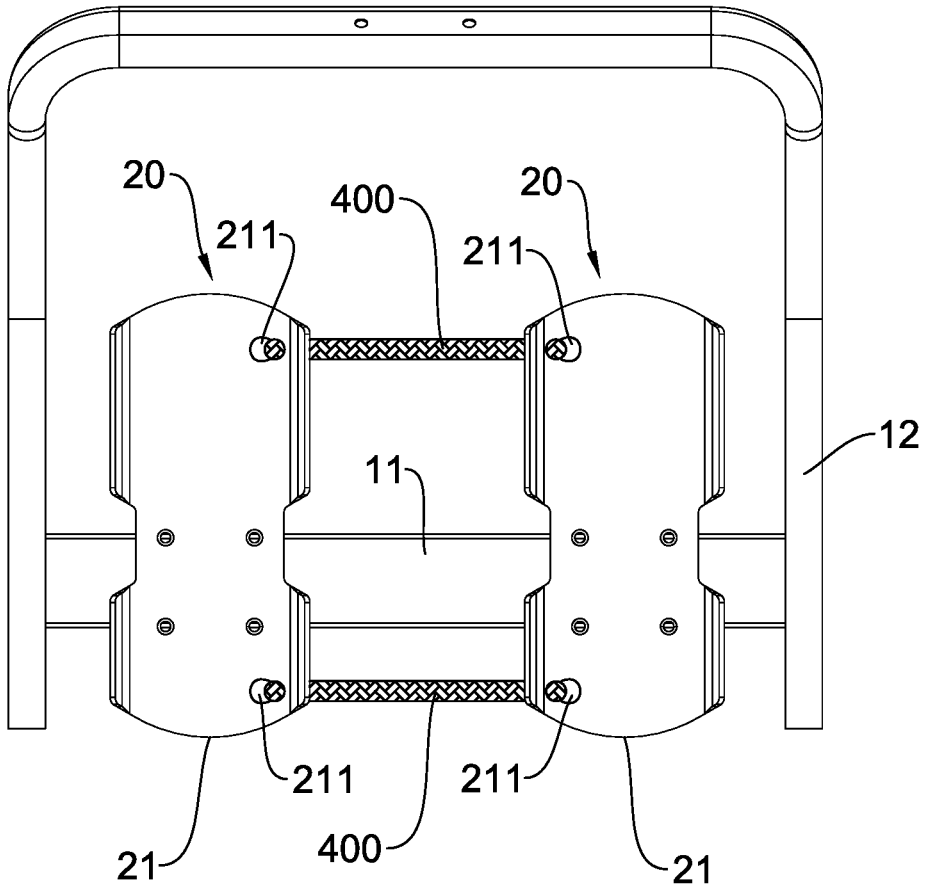
FIG. 15 shows another embodiment of the restriction members.

FIG. 15 shows another embodiment of the restriction members 400, wherein, each of the boards 21 includes two bores 211, and the two boards 21 are located parallel to each other. The two restriction members 400 are respectively connected between the two boards 21. One of two ends of each restriction member 400 is connected to one of the bores 21 of one of the two boards, 21, another one of the two ends of each restriction member 400 is connected to one of the two boards 21 of another one of the two boards 21. When in use, the two restriction members 40 help the pedals 10 to return.

The damp unit 33 can be a spring, a compression spring, a shock absorbing device, a pneumatic device, a hydraulic device or a resistance-adjustable device.

While we have shown and described the embodiment in accordance with the present invention, it should be clear to those skilled in the art that further embodiments may be made without departing from the scope of the present invention.

What is claimed is:

1. An ankle exerciser comprising:

a base having a bar and a frame, the bar transversely connected to the frame and including two installation positions;

two pedals respectively installed to the bar, each pedal including a board and a first belt which is mounted to the board, a socket connected to an underside of each of the two pedals and including a plate, a brace and a ball bearing, the plate located between the underside of the pedal and the brace, the brace including a room in which the ball bearing is located, and two rotary units respectively located between the base and the two pedals so that the two pedals are rotatable by the two rotary units, each rotary unit including a shaft, a cup, a damp unit, a collar and a joint unit, a bolt extending through the shaft, the cup, the damp unit, the collar and the joint unit so as to be connected to the joint unit, the shaft located on a top of the bar and located corresponding to the installation position, the shaft including a passage defined axially through, a bottom portion formed to a lower end of the shaft, the cup contacting the bottom portion, the damp unit located between the cup and the collar, the collar positioning the socket and including a receiving portion facing downward in which the damp unit is received, the joint unit including a ball formed to a top end thereof, the ball bearing mounted to the ball, a lower section of the joint unit inserted into the passage of the shaft, the bolt connected to a threaded hole in the lower section of the joint unit, when in use, each of the pedals is pivoted about the joint unit, and each of the pedals returns by the damp unit.

2. The ankle exerciser as claimed in claim 1, wherein the bottom portion of the shaft includes ratchets with different heights, the cup includes recesses formed in an inner periphery thereof, when the cup is rotated, the recesses are detachably engaged with the ratchets to generate different damp levels to the damp unit.

3. The ankle exerciser as claimed in claim 1, wherein the damp unit is a compression spring.

4. An ankle exerciser comprising:

a base having a bar and a frame, the bar transversely connected to the frame and including two installation positions;

two pedals respectively installed to the bar, each pedal including a board and a first belt which is mounted to the board, a socket connected to an underside of each of the two pedals and including a plate, a brace and a ball bearing, the plate located between the underside of the pedal and the brace, the brace including a room in which the ball bearing is located;

two rotary units respectively located between the base and the two pedals so that the two pedals are rotatable by the two rotary units, each rotary unit including a shaft, a cup, a damp unit, a collar and a joint unit, a bolt extending through the shaft, the cup, the damp unit, the collar and the joint unit so as to be connected to the joint unit, the shaft located on a top of the bar and located corresponding to the installation position, the shaft including a passage defined axially through, a bottom portion formed to a lower end of the shaft, the cup contacting the bottom portion, the damp unit located between the cup and the collar, the collar positioning the socket and including a receiving portion facing downward in which the damp unit is received, the joint unit including a ball formed to a top end thereof, the ball bearing mounted to the ball, a lower section of the joint unit inserted into the passage of the shaft, the bolt connected to a threaded hole in the lower section of the joint unit, and each pedal including two paths which are formed between the board and the plate, the two paths located corresponding to a front end and a second end of the board, two restriction members respectively restricting the two pedals relative to the bar, wherein each one of the two restriction members is a loop and goes below the bar and extends through the two paths of each board to restrict the two pedals relative to the bar, when in use, each of the pedals is pivoted about the joint unit, and each of the pedals returns by the damp unit and a respective one of the two restriction members.

5. The ankle exerciser as claimed in claim 4, wherein the bottom portion of the shaft includes ratchets with different heights, the cup includes recesses formed in an inner periphery thereof, when the cup is rotated, the recesses are detachably engaged with the ratchets to generate different damp levels to the damp unit.

6. The ankle exerciser as claimed in claim 4, wherein each of the boards includes two bores, two ropes respectively connected between the two boards, wherein each rope is connected to a separate set of the two bores on each of the two boards.

7. The ankle exerciser as claimed in claim 4, wherein the damp unit is a compression spring.

8. An ankle exerciser comprising:

a base having a bar and a frame, the bar transversely connected to the frame and including two installation positions;

two pedals respectively installed to the bar, each pedal including a board and a first belt which is mounted to the board, a socket connected to an underside of each of the two pedals and including a plate, a brace and a ball bearing, the plate located between the underside of the pedal and the brace, the brace including a room in which the ball bearing is located;

two rotary units respectively located between the base and the two pedals so that the two pedals are rotatable by the two rotary units, each rotary unit including a shaft, a cup, a damp unit, a collar and a joint unit, a bolt extending through the shaft, the cup, the damp unit, the collar and the joint unit so as to be connected to the joint unit, the shaft located on a top of the bar and located corresponding to the installation position, the shaft including a passage defined axially through, a bottom portion formed to a lower end of the shaft, the cup contacting the bottom portion, the damp unit located between the cup and the collar, the collar positioning the socket and including a receiving portion facing downward in which the damp unit is received, the joint unit including a ball formed to a top end thereof, the ball bearing mounted to the ball, a lower section of the joint unit inserted into the passage of the shaft, the bolt connected to a threaded hole in the lower section of the joint unit;

each pedal including two paths which are formed between the board and the plate, the two paths located corresponding to a front end and a second end of the board, two restriction members respectively restricting the two pedals relative to the bar, wherein each one of the two restriction members is a loop and goes below the bar and extends through the two paths of each board to restrict the two pedals relative to the bar, a handle is connected to the base and includes a post and an armrest, when in use, each of the pedals is pivoted about the joint unit, and each of the pedals returns by the damp unit and a respective one of the two restriction members.

9. The ankle exerciser as claimed in claim 8, wherein the bottom portion of the shaft includes ratchets with different heights, the cup includes recesses formed in an inner periphery thereof, when the cup is rotated, the recesses are detachably engaged with the ratchets to generate different damp levels to the damp unit.

10. The ankle exerciser as claimed in claim 8, wherein the base includes two lugs, the post of the handle is pivotably connected between the two lugs by a pin so that the base is pivoted relative to the handle.

11. The ankle exerciser as claimed in claim 10, wherein multiple resilient members are connected between the post and the two lugs, the resilient members are springs, each lug includes a groove, two notches are formed in two ends of each groove, the two notches communicate with the groove corresponding thereto, one of two ends of each resilient member is connected to the pin, a rod movably extends through the two grooves and is removably engaged with one of the two notches of each groove to position the post.

12. The ankle exerciser as claimed in claim 8, wherein the post includes a slot, a restriction part is adjustably movable along the slot of the post so as to position a user's legs.

13. The ankle exerciser as claimed in claim 12, wherein the restriction part includes two second belts and a bridge, two contact plates are formed to two sides of the bridge, the second belts are connected to the two contact plates, the second belts are adapted to position the user's legs.

14. The ankle exerciser as claimed in claim 8, wherein each of the boards includes two bores, two ropes are respectively connected between the two boards, wherein each rope is connected to a separate set of the two bores on each of the two boards.

15. The ankle exerciser as claimed in claim 8, wherein the damp unit is a compression spring.

* * * * *